United States Patent [19]

Todd, Jr.

[11] Patent Number: 4,586,201

[45] Date of Patent: May 6, 1986

[54] TOILET AIR PURIFIER APPARATUS

[76] Inventor: Ray R. Todd, Jr., 2003 Partridge, Bldg. D, Tyler, Tex. 75701

[21] Appl. No.: 609,770

[22] Filed: May 14, 1984

[51] Int. Cl.[4] ..... E03D 9/4

[52] U.S. Cl. ..... 4/217; 4/213

[58] Field of Search ..... 4/209 R, 210, 213, 216, 4/217, 234

[56] References Cited

U.S. PATENT DOCUMENTS

| | | | |
|---|---|---|---|
| 1,794,635 | 3/1931 | Mills | 4/217 |
| 2,320,065 | 5/1943 | Briscoe et al. | 4/213 |
| 2,849,727 | 9/1958 | Bollinger et al. | 4/217 |
| 3,277,499 | 10/1966 | Keeauver | 4/213 |
| 3,335,431 | 8/1967 | Coates | 4/213 |
| 3,416,167 | 12/1968 | Klemme | 4/217 |
| 3,659,296 | 5/1972 | Stamper | 4/217 |
| 3,689,944 | 9/1972 | Clayton | 4/213 |
| 3,790,970 | 2/1974 | Bendersky | 4/217 |
| 3,916,459 | 11/1975 | Ivancevic | 4/213 |
| 3,953,901 | 5/1976 | Poister et al. | 4/217 |
| 4,344,194 | 8/1982 | Pearson | 4/213 |

*Primary Examiner*—Stephen Marcus
*Assistant Examiner*—Linda J. Sholl
*Attorney, Agent, or Firm*—Vaden, Eickenroht, Thompson & Jamison

[57] ABSTRACT

An improved apparatus for ventilating and purifying the unpleasant bathroom odors arising from the bowl of a water closet type commode. The apparatus has a seat and lid commonly mounted upon pintles for swinging relatively to one another and to the bowl. The lid carries a tubular shutter valve, which is closed except when the lid is open, for sealing the filter and motor elements carried within a sealed compartment in the lid from air inlets in the seat. The seat has a concealed air inlet opening downwardly at the rear edge of the bowl. Water cannot traverse the shutter valve and injure the filter or motor.

6 Claims, 7 Drawing Figures

FIG. 1
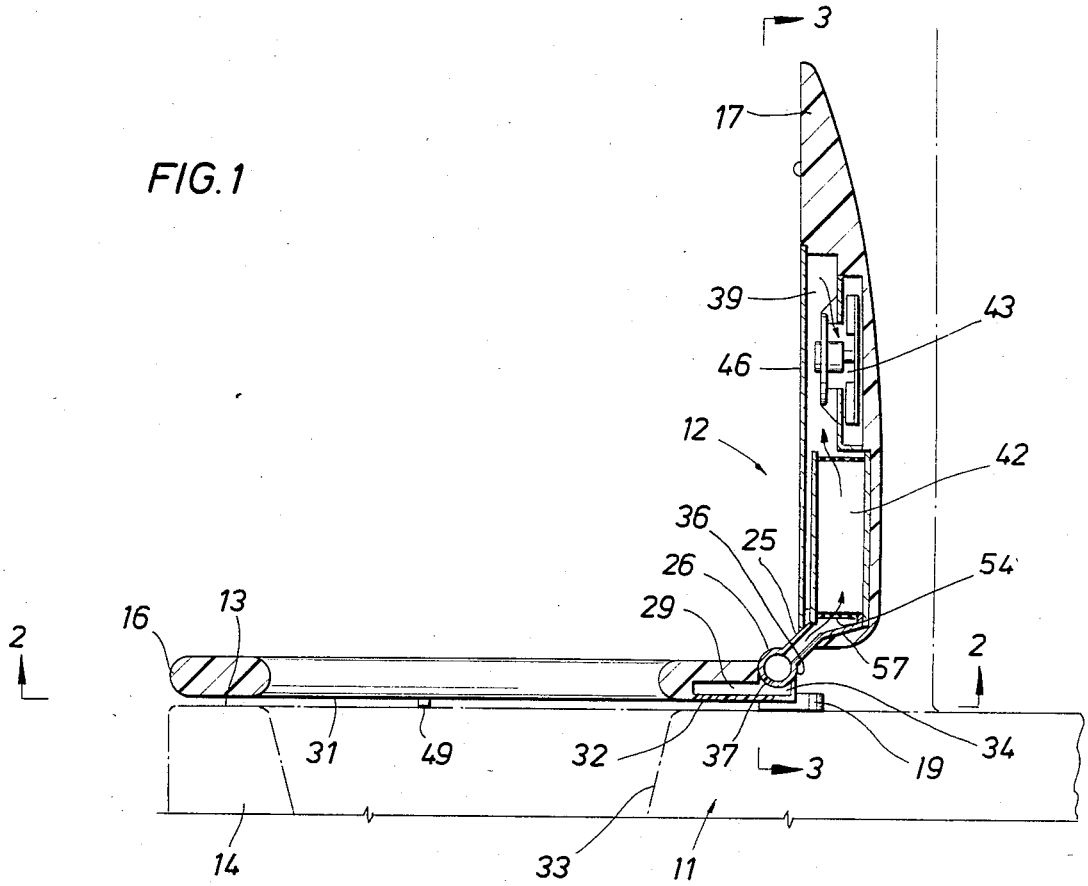
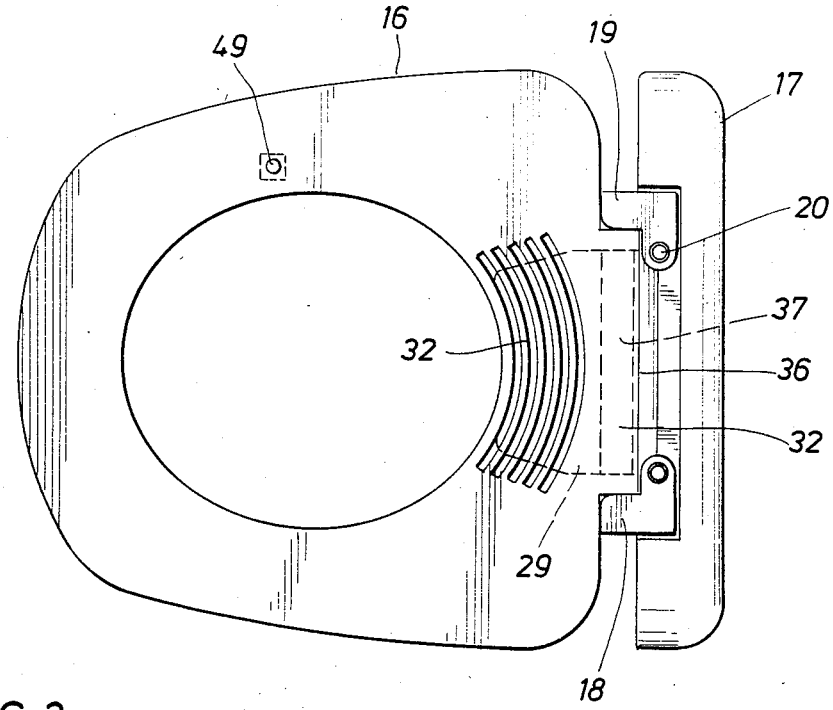
FIG. 2

FIG. 3
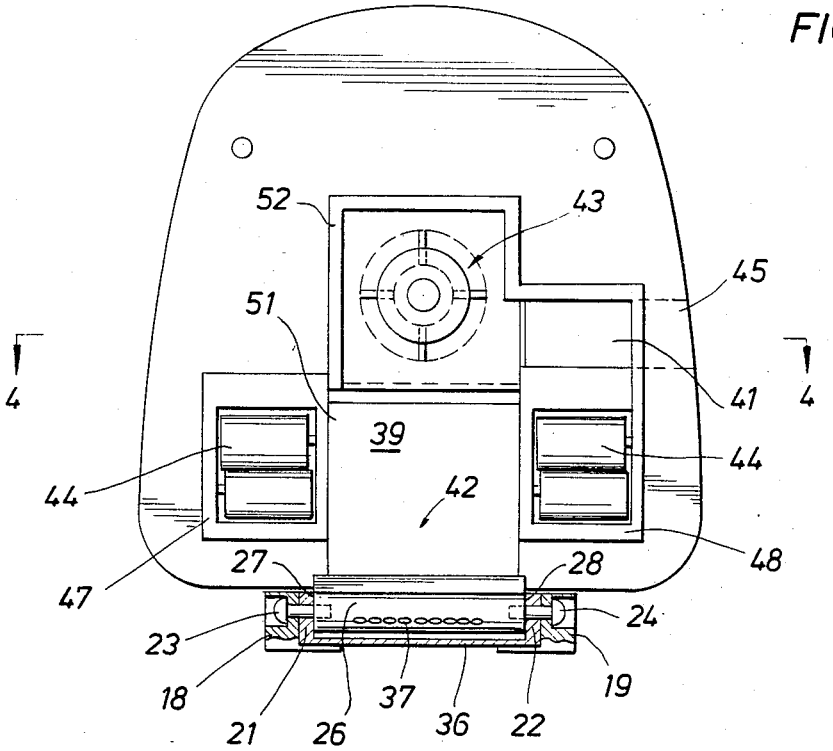
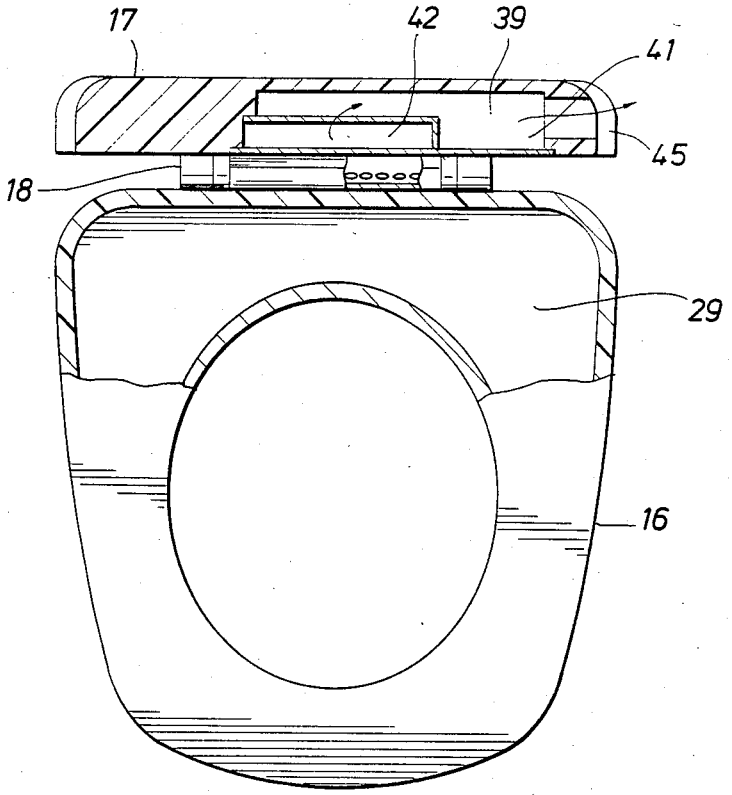
FIG. 4

TOILET AIR PURIFIER APPARATUS

BACKGROUND OF THE INVENTION

1. Field of the Invention

This invention relates to system for ventilating water closets, and it relates more particularly to systems for the removal and purification of odorous gases associated with water closets.

2. Description of the Prior Art

Various systems in both process and apparatus have been proposed for the removal and purification of odorous gases associated with the uses of water closets or flush toilets as they are more commonly designated. Many of these devices require specially configured water closets, and other devices are very complex in construction. As a result, none of these prior art devices have found any significant consumer acceptance, especially by the householder.

The better devices have the following characteristics (1) attachment to any conventional water closet without floor supported components, (2) safe operation, especially as to electrical shock hazards (3) protected against liquid contamination, especially upon overflows of the bowl, (4) sanitary construction with easy-to-clean assemblies and (5) long life service.

Some of these devices were add-on units for attachment to conventional water closets having the usual bowl, tank, pedestal and folding lid and seat arrangements. These add-on devices work well but can be unsightly in appearance. Other devices are built into the seat and lid, however, these devices are so cumbersome and awkward that consumer acceptance is small.

SUMMARY OF THE INVENTION

The present invention in apparatus provides a seat and lid combination that attaches to the conventional water closet in substitution for the conventional seat and lid. The seat carries a unique air inlet and internal passageway connected to the lid via a shutter valve. The lid has a sealed internal compartment with an electric blower moving air from the shutter valve through a canister which removes odors, and discharges a purified air stream from the lid. The valve seals the lid's air inlet to the cannister when the lid is resting against the seat. As a result, the canister is protected from liquids, moisture and exposure when the lid is resting against the seat.

DESCRIPTION OF THE DRAWINGS

FIG. 1 is a side elevation of the present apparatus, showing the seat and lid in partial section, and with their pivotal attachment to the bowl-pedestal of a conventional water-closet;

FIG. 2 is a plan view of the apparatus shown in FIG. 1 with a partial section along line 2—2 of the seat at its rearward portion for illustrating an internal passageway;

FIG. 3 is a section of the apparatus of FIG. 1 taken along line 3—3; illustrating the internal compartments in the lid;

FIG. 4 is a section of the apparatus of FIG. 3 taken along line 4—4 illustrating the internal air passageway in the seat and its connection to the air inlet of the lid.

In the drawings, the several embodiments of the improved apparatus have common elements of construction. In regard to the several figures, like elements carry like numerals to simplify description of these embodiments.

DESCRIPTION OF PREFERRED EMBODIMENTS

Figure 5:
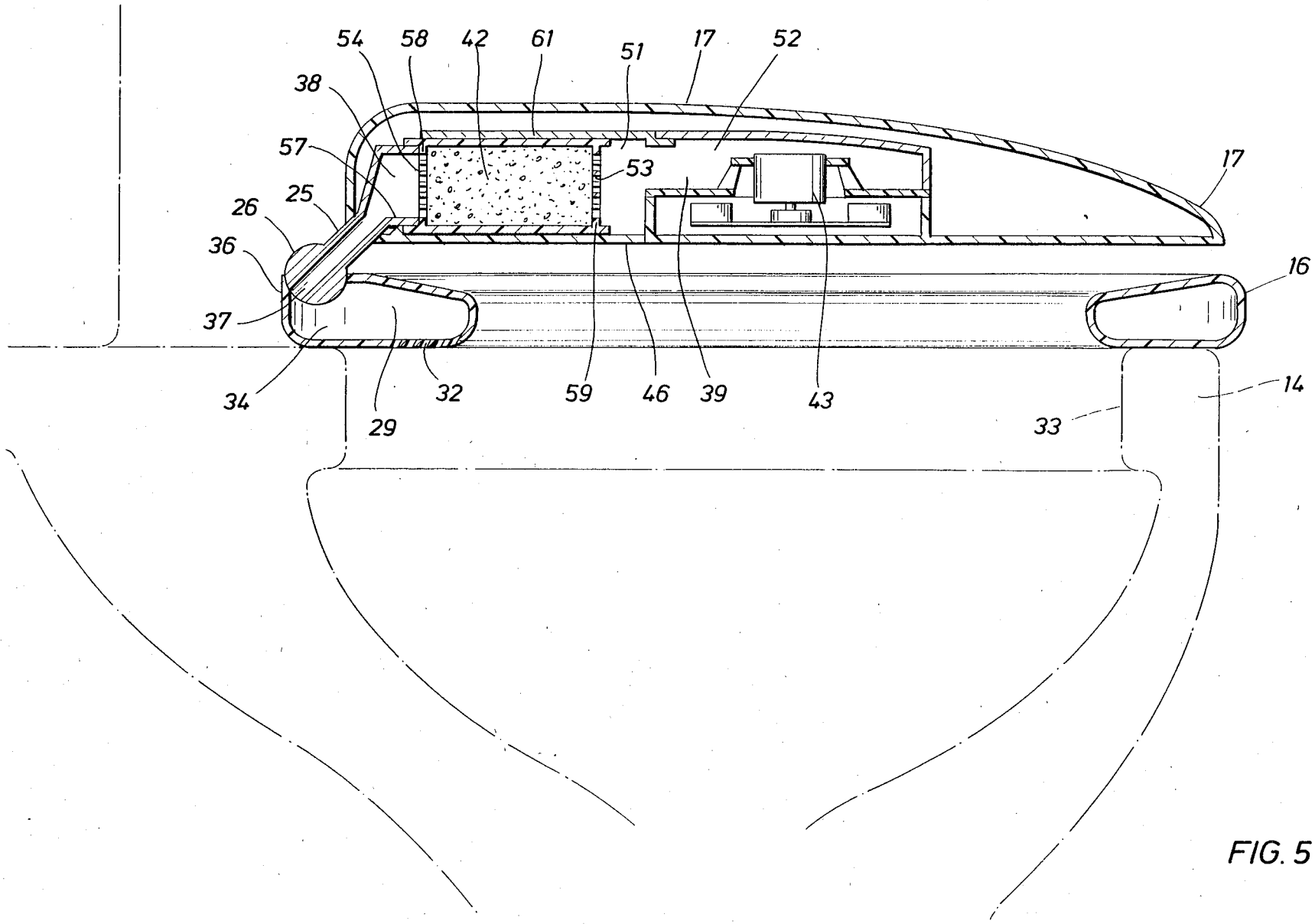
FIG. 5 is a section in enlargement of the lid shown in FIG. 1 for illustrating the arrangement of the filter cartridge used in the apparatus.
Figure 7:
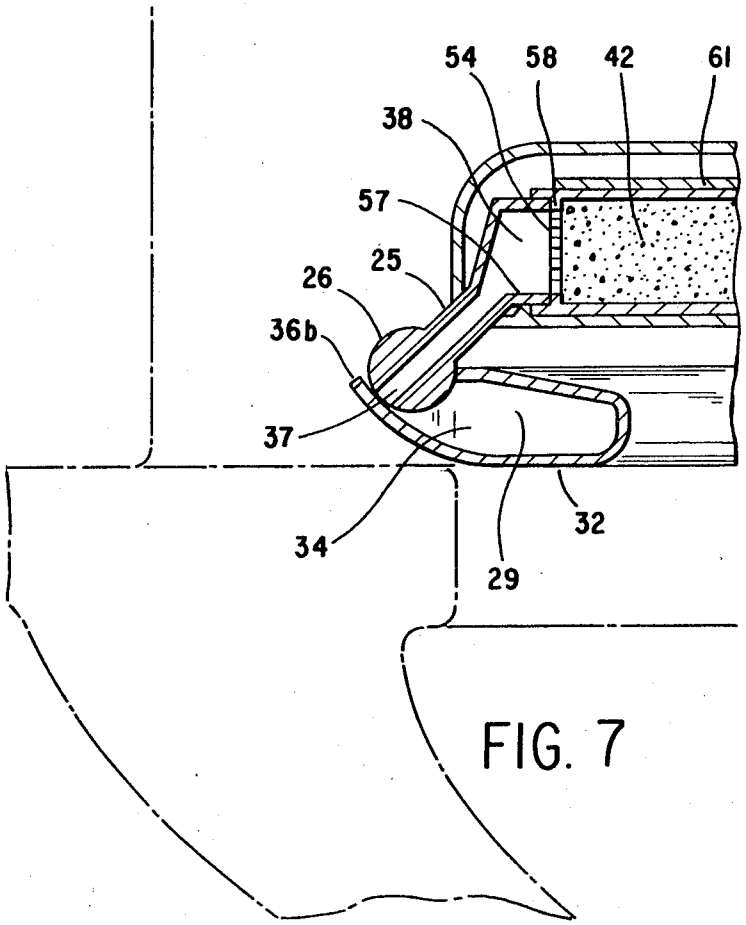
FIG. 7 is a partial section in enlargement of the lid shown in FIG. 1 wherein the valve member is sealed against the rearward wall of the trough when the lid is in its lowered position.

Referring to FIGS. 1–4, there is shown a conventional toilet 11, such as a water closet, on which is mounted the present apparatus 12. This apparatus 12 rests upon the flat top surface 13 above the bowl 14. More particularly, the apparatus 12 includes a seat 16 and lid 17 which are commonly swung about a pivotal mounting to pintles 18 and 19. The seat 16 is of conventional configuration and aligns with the central opening 21 in the bowl 14. The lid 17 conforms in contour to the seat 16 but many have a slightly "fatter" body portion to accommodate certain elements of this apparatus. The seat and lid can be of plastic material which are molded into the desired external and internal configurations.

The pintles 18 and 19 are bolted onto the surface 13 by usual threaded fasteners 20. The seat 16 carries integrally hinge rings 21 and 22 which have axial openings to receive pivot pins 23 and 24. Thus, the seat pivots directly from the pintles on these pins. The lid 17 carries an integral angled bracket 25 which extends rearwardly and downwardly (relative to the lid being horizontal). The bracket 25 of rectangular walled construction extends to a tubular member 26 which extends horizontally between the rings 21 and 22 of the seat 16. The member 26 has solid ends 27 and 28 which have axial openings to receive the pins 23 and 24. Thus, the seat pivots directly upon the pintels via these pins. Also, the lid and seat pivot independently of one another upon the pintels via these pins 23 and 24.

The seat 16 has an internal cavity or passageway 29 which is a horizontal opening parallel to the lower surface 31 of the seat. This passageway 29 extends from downwardly opening air inlets 32, which inlets are crescent shaped (at curvature not less than the rear curved shape of the bowl) and extending rearwardly from the rear edge 33 of the bowl 14. With the configuration, air eduction can be made via these inlets 32 and a circulating laminar sweeping flow of air from front-to-back through the bowl 14. This air flow effectively removes the odorous gases from the bowl and carries them into the inlets 32.

The passageway 29 opens into a trough or plenium chamber 34 located at the rear of the seat 16. This chamber 34 can be formed by an angled wall 36 supported from the seat. The wall 36 can be integrally molded into the seat, and it would extend between the rings 21 and 22. Preferably, the wall 36 is arranged in height and spacing to overlay the tubular member 26 about mid height, or to a horizontal plane passing through the axis of rotation about the pins 23 and 24. The wall 36 does not need to form an air tight seal to the member 26. Good results are obtained where the wall 36 is slightly spaced from the member 26 so that any water inadvertently present in the passageway 29 will be vented or drained by this spaced opening when the seat is pivoted upright.

The member 26 provides a shutter valve to air flow from the passageway 29 into the internal compartments in the lid. For this purpose, the member 26 is provided with one or more radial holes 37 (or even a continuous axial slot). These holes are aligned with the chamber 34 when the lid is opened from the seat, but these holes are closed by the wall 36 when the lid and seat rest together (in upright or flat positions). The educted air then is controlled in its flow from the passageway 29 through these holes 37 into the member 26, and then into an air inlet 38 provided in the lid.

The lid 17 has an internal sealed compartment 39 which is in communication at one end with the air inlet38 and an air outlet 41. The outlet 41 best can be a gill-like opening 45 in the side surface of the lid where it is inconspicuous to the user and relatively immune from collecting dust, solids such as hair pins or cleaning liquids. The internal compartment 39 provides a housing for various operative elements including a filter 42, an electric powered blower 43, and batteries 44. The compartment 39 is covered at its lower surface by a removeable wall 46 which can be secured by snap-in clips etc.

Preferably, the compartment 39 is divided into several chambers to contain the operative elements. The electrical terminals and connecting wiring (not shown) can be molded integral with the lid so that there is no exposed wires etc. For this purpose, rectangular chambers 47 and 48 are provided for the batteries 44, and insertion of these batteries provides the electrical connection there into with the power circuit for the blower 43, a flexible lead (not shown) extends from the blower and batteries to a push button switch 49 that extends downwardly from the seat 16 into contact with the surface 31 of the bowl. A person's weight on the seat closes the switch 49 and activates the blower 43 into operation. The blower 43 preferably should be placed into a chamber 52 closely adjacent to filter outlet 53, as a result, the blower 43 educts air from this outlet 53 and expells same longitudinally from the chamber 52 into the outlet 41. The filter 42 is arranged as a rectangular cartridge for insertion into the chamber 51, and has a side inlet 54 to receive air flow from the blower 43 and a side outlet 53 to discharge deodorized air into the compartment 39.

The bracket 25 preferably has a nozzle end 57 forming the inlet 38 which projects into and abuts the side inlet 54 of the filter 42. As a result, no bypass air can enter the filter 42. All incoming air must flow via the bracket 25.

The odorous air must transverse laterally the filter 42, and be exposed to the purifying action of its granular filter medium. This medium is a commercial product, and it has a relatively long life since the chemical agents, to some extent regenerate in the presence of a small concentration of moisture. The arrangement of the tubular member 26, as the shuttle valve, closes the air inlet 38 to continued air flows through the lid and maintains moisture contact in the medium at near agent regeneration levels. In air-conditioned environments, or in very dry climates, this valve closing function is important to long effective filter life.

Preferably, the blower is located between the filter 42 and air outlet 41 so as to prevent circulating air flows into the inlet side of the filter cartridge.

If desired, the blower 43 can be controlled for run time duration by a time controller circuit. However, this feature is not important where the batteries 44 are of the long life type. With four, series connected alkaline D type batteries, a blower 42 with a capacity of about 5CFM will operate for over one year in a four person average household.

The filter 42 can be constructed in a variety of arrangements. As seen in FIG. 5, the filter is preferably rectangular in configuration with non-porous top, bottom and end walls. The sides or ends 58 and 59 are perforated to serve as air inlet and outlet between the nozzle 57 and blower 43. The top, bottom and end walls can extend beyond the ends 58 and 59, and the nozzle 57 can be snugly captured within these extensions so as to be firmly seated against the inlet end 58. The filter is held tightly in place between a compartment wall 61 and the removable wall 46. With this arrangement, the filter 42 can be easily and quickly replaced, when necessary.

Figure 6:
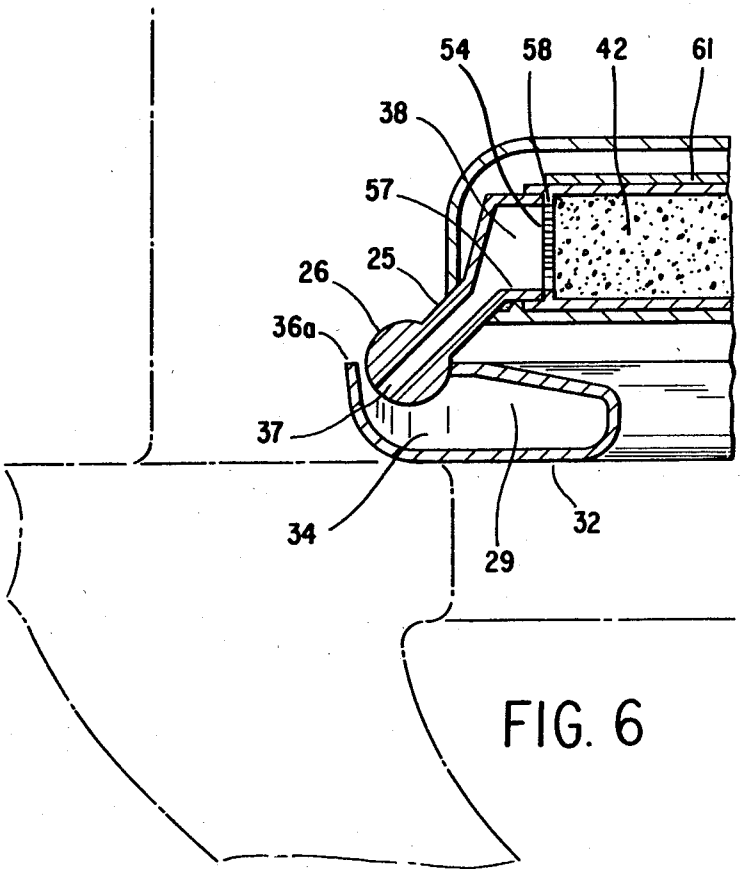
FIG. 6 is a partial section in enlargement of the lid shown in FIG. 1 wherein the rearward wall of the trough is spaced a small distance from the imperforate portion.

FIG. 6 illustrates an alternate embodiment of the invention wherein rearward wall **36*a* of the trough is spaced a small distance from member 26. Further 7 illustrates another alternate embodiment wherein rearward wall 36*b* seals against the opening ball member 26** when the lid is in its lowered position.

From the foregoing, it will be apparent that there has been provided an improved novel apparatus for ventilating and purifying foul odors from the bowl of a water closet. It will be appreciated that certain changes or alternations in the present apparatus can be made without departing from the spirit of this invention. These changes are contemplated by and are within the scope of the appended claims which define the invention. Additionally, the present description is intended to be taken as an illustration of this invention.

What is claimed is:

1. An improved apparatus for ventilating and purifying unpleasant bathroom odors rising from the bowl of a commode, comprising;

(a) a toilet seat having an air inlet opening into said bowl;

(b) a toilet lid having an internal compartment with an air outlet in an exterior surface, and an air outlet in a rearward edge;

(c) a pair of spaced pintles adapted to be secured to the bowl and providing an independent pivotal mount for said seat and said lid on respective rearward edges;

(d) said seat having an internal passageway extending from said air inlet to an air outlet in its rearward edge located between said pintles and facing rearwardly of said seat;

(e) said lid having a tubular valve member carried in said rearward face and located between said pintles said seat carrying a trough joining a rearward boundry of said air inlet on said seat, and said tubular valve member being received within said trough;

(f) said tubular valve member having a radial opening positioned to align with said air outlet on said seat when the lid is in raised position and said tubular valve member having an imperforate portion sealing said air outlet on said seat when said lid is resting upon said seat; and (g) said lid having a means for moving air from said valve member to said interal compartment and a means for removing odor from air moving in said compartment between said air inlet and said outlet on said lid, wherein said axial opening in said tubular valve member is sealed against the rearward wall of said trough when said lid is resting against said seat.

2. The improved apparatus of claim 1 wherein said rearward wall of said trough is spaced a small distance from the imperforate portion of said tubular valve member whereby any liquid in said air outlet of said seat can safely be diverted from said axial opening.

3. The improved apparatus of claim 2 wherein said air inlet of said seat are a plurality of downwardly facing crescent-shaped openings extending from said internal passageway, and said openings positioned at the rear edge of said bowl.

4. The improved apparatus of claim 1, wherein said lid is fabricated with open bottom chambers forming said internal compartment and a removable cover enclosing said chambers, electrical circuitry confined within said lid connecting a battery supply in one chamber with a seat mounted control switch and a motorized blower mounted within another chamber, and a replaceable filter cartridge mounted in another chamber, and said chambers arranged for air flows therethrough between said air inlet and outlet on said lid, said chambers are rectangular in configuration, said filter cartridge is rectangular with one perforated side facing said air inlet on said lid and an opposite side facing said chamber containing said blower and said tubular valve member connects via a projecting nozzle directly against the air inlet side of said filter cartridge, said filter cartridge has non-perforated enclosing walls projecting beyond said perforated side, and said projecting nozzle is captured by said projecting walls so as to rest snuggly against said perforated sides of said filter cartridge during normal operation.

5. For use with a toilet having a bowl, an air ventilating and purifying apparatus, comprising;

(a) a toilet seat having an internal passageway extending from a downwardly depending inlet opening to an outlet opening in a rearward edge of said seat;

(b) a toilet lid having an internal compartment with an inlet opening adjacent a rearward edge of said lid, and an outlet opening, said lid having means for moving air from said inlet opening through said internal compartment to said lid outlet opening for expulsion exteriorly of said lid, said lid further including means within said internal compartment for removing odor for air circulated therethrough;

(c) a pair of spaced pintles adapted to be secured to the bowl for providing an independent pivotal mount for said seat and said lid on their respective rearward edges; and (d) a tubular valve mounted on said rearward edge of said lid having one or more radial holes connected to said inlet opening of said lid, said tubular valve being pivotally received within a trough mounted on a rearward edge of said said, said trough joining a rearward boundry of said outlet opening on said seat, said radial holes of said tubular valve being rotated into alignment with said outlet opening of said seat when said lid is in a raised position so as to convey air from the bowl through the passageway in said seat and into said internal compartment of said lid for removal of odors from the air, and said radial of said tubular valve being rotated out of alignment with said outlet opening of said seat when said lid is resting on said seat, wherein said radial holes of said tubular valve member are sealed against a rearward wall of said trough when said lid is resting against said seat.

6. For use with a toilet having a bowl, an air ventilating and purifying apparatus, comprising:

(a) a toilet seat having an internal passageway extending from a downwardly depending inlet opening to an outlet opening adjacent a rearward edge of said seat;

(b) a toilet lid having an internal compartment with an inlet opening adjacent a rearward edge of said lid, and an outlet opening, said lid having means for moving air from said inlet opening through said internal compartment to said lid outlet opening for expulsion exteriorly of said lid, said lid further including means within said interal compartment for removing odor for air circulated therethrough;

(c) a pair of spaced pintles adapted to be secured to the bowl for providing an independent pivotal mount for said seat and said lid on their respective rearward edges; and (d) a tubular valve mounted on said rearward edge of said lid having one or more radial holes connected to said inlet opening of said lid, said tubular valve being pivotally received within a trough mounted on a rearward edge of said seat, said trough joining a rearward boundry of said outlet opening on said seat, said radial holes of said tubular valve being rotated into alignment with said outlet opening of said seat when said lid is in a raised position so as to convey air from the bowl through the passageway in said seat and into said internal compartment of said lid for removal of odors from the air, and said radial holes of said tubular valve being rotated out of alignment with said outlet opening of said seat when said lid is resting on said seat, wherein said rearward wall of said trough is spaced a small distance from the radial holes of said tubular valve member whereby any liquid adjacent said outlet opening of said seat can be safely diverted from said radial holes.

* * * * *